US007773908B2

(12) United States Patent
Fujiwara

(10) Patent No.: US 7,773,908 B2
(45) **Date of Patent: *Aug. 10, 2010**

(54) IMAGE FORMING APPARATUS WITH CLEANING DEVICE THAT DOES NOT CAUSE EXCESSIVE CUTTING AND CLEANING METHOD

(75) Inventor: Shigeru Fujiwara, Kanagawa-ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 12/428,598

(22) Filed: Apr. 23, 2009

(65) Prior Publication Data

US 2009/0208243 A1 Aug. 20, 2009

Related U.S. Application Data

(63) Continuation of application No. 11/447,346, filed on Jun. 6, 2006, now Pat. No. 7,542,695.

(30) Foreign Application Priority Data

Jun. 30, 2005 (JP) ..... 2005-192851

(51) Int. Cl.
*G03G 15/16* (2006.01)

(52) U.S. Cl. ..... 399/101; 399/297

(58) Field of Classification Search ..... 399/101, 399/297, 350, 351

See application file for complete search history.

(56) References Cited

U.S. PATENT DOCUMENTS

| | | | | |
|---|---|---|---|---|
| 4,924,272 | A | 5/1990 | Hediger et al. | |
| 5,708,928 | A | 1/1998 | Fukunaga | |
| 6,865,361 | B2 | 3/2005 | Abe et al | |
| 7,113,733 | B2 | 9/2006 | Ito et al. | |
| 7,277,657 | B2 | 10/2007 | Uchida et al. | |
| 7,383,001 | B2 | 6/2008 | Fukao | |
| 7,542,695 | B2 * | 6/2009 | Fujiwara | 399/101 |

* cited by examiner

*Primary Examiner*—William J Royer
(74) *Attorney, Agent, or Firm*—Turocy & Watson, LLP

(57) ABSTRACT

In an image forming apparatus including a cleaning device having a cleaning blade arranged so as to make contact with and separate from a cleaned surface, an occurrence of excessive cutting when the cleaning blade makes contact with the cleaned surface is prevented. The image forming apparatus includes the cleaning blade for making contact with and separating from the cleaned surface and scraping off toner adhered onto the cleaned surface and a regulation member for regulating a movement of the cleaning blade in the direction of contact with the cleaned surface up to a position where a pressing force to the cleaned surface by the cleaning blade does not exceed a predetermined pressing force.

20 Claims, 2 Drawing Sheets

IMAGE FORMING APPARATUS WITH CLEANING DEVICE THAT DOES NOT CAUSE EXCESSIVE CUTTING AND CLEANING METHOD

CROSS-REFERENCE TO RELATED APPLICATIONS

This application claims the benefit of priority from and is a continuation of co-pending application Ser. No. 11/447,346 filed on Jun. 6, 2006, which is based upon and claims the benefit of priority from the prior Japanese Patent Application No. 2005-192851, filed on Jun. 30, 2005, the entire contents of both of which are incorporated herein by reference.

BACKGROUND OF THE INVENTION

The present invention relates to an image forming apparatus having a cleaning device and a cleaning method.

Conventionally, in an image forming apparatus, to remove unnecessary toner adhered to a photosensitive surface of a photoconductor and a transfer surface of an intermediate transfer medium, a cleaning device is used. In the cleaning device, a cleaning blade is used. The cleaning blade has a front end arranged so as to make contact with and separate from the photosensitive surface and transfer surface and scrapes off unnecessary toner adhered to the photosensitive surface and transfer surface.

FIG. 4 shows the constitution of the circumference of a cleaning device of a conventional image forming apparatus. As shown in FIG. 4, a cleaning device 9 of the conventional image forming apparatus removes unnecessary toner adhered to the transfer surface of an intermediate transferring belt 3.

The cleaning device 9 is installed so as to rotate with a rotating shaft R' as a rotational center. The front end of a cleaning blade 901 is pressed against a cleaned surface by a pressing unit 2 composed of a tension spring.

Further, when separating the cleaning blade 901 from the cleaned surface, the cleaning blade 901 is separated against a pressing force (in a direction F shown in the drawing) of the pressing unit 2 using a cam (not shown).

By use of the constitution of the cleaning device 9 of the conventional image forming apparatus aforementioned, to make the cleaning blade contact with the cleaned surface, when released from control force by the cam, the front end of the cleaning blade 901 moves toward the cleaned surface by the pressing force applied by the pressing unit 2.

In such a constitution, when the force by the pressing unit 2 is strong, the front end of the cleaning blade 901, as shown by a dashed line in the drawing, is applied with higher pressure than the contact pressure originally appropriate to cleaning, thereby the front end of the cleaning blade 901 is excessively cut into the cleaned surface (hereinafter, referred to as "excessive cutting"). That is, the cleaning blade 901 and cleaned surface are applied with an excessive load and there is a possibility that the cleaning blade 901 and cleaned surface may be adversely affected in the span of life.

SUMMARY OF THE INVENTION

The present invention was developed to solve the problem aforementioned and is intended to provide an image forming apparatus including a cleaning device having a cleaning blade arranged so as to make contact with and separate from a cleaned surface for preventing an occurrence of excessive cutting when the cleaning blade makes contact with the cleaned surface and a cleaning method.

To solve the problem aforementioned, the present invention provides an image forming apparatus of an embodiment relating to the present invention, comprising a cleaning blade to make contact with and separate from a cleaned surface and scrape off toner adhered onto the cleaned surface at time of contact; and regulation means for regulating a movement of the cleaning blade in a direction of contact with the cleaned surface up to a position where the cleaned surface is pressed by a predetermined pressing force by the cleaning blade.

Furthermore, the present invention provides a cleaning method in an image forming apparatus of an embodiment relating to the present invention, comprising moving a cleaning blade in a direction of making contact with a cleaned surface; regulating a movement up to a position where the cleaned surface is pressed by a predetermined pressing force by the cleaning blade; and scraping off toner adhered onto the cleaned surface when the cleaned surface is pressed by the predetermined pressing force.

DETAILED DESCRIPTION OF THE EMBODIMENTS

Hereinafter, an embodiment of the present invention will be explained with reference to the accompanying drawings.

Figure 1:
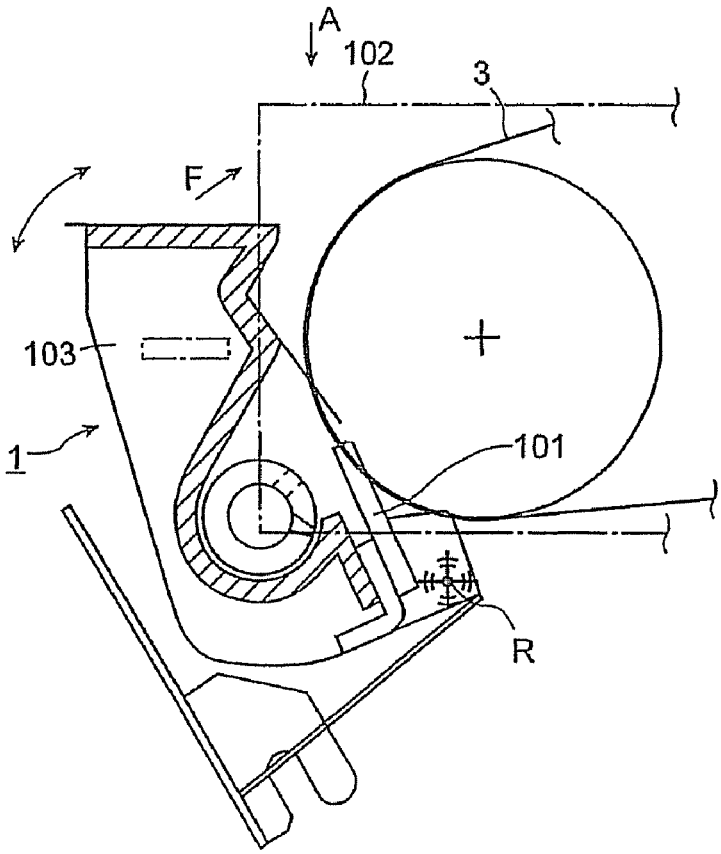
FIG. 1 is a schematic block diagram showing an image forming apparatus including a cleaning device of an embodiment of the present invention.

As shown in FIG. 1, an image forming apparatus of the embodiments of the present invention comprises, for example, a multi function peripheral (MFP).

A cleaning device 1 of the image forming apparatus of this embodiment is arranged in the neighborhood of an intermediate transferring belt 3 for transferring a toner image on a sheet. The cleaning device 1 comprises a cleaning blade 101, a first regulation member 102, and a second regulation member 103.

The cleaning device 1 is installed so as to make contact with and separate from a transfer surface of the intermediate transferring belt 3 which is a cleaned surface. It has the cleaning blade 101 for scraping off toner adhered onto the transfer surface at time of contact.

The cleaning device 1 is installed so as to rotate with a rotating shaft R as a rotational center. By this rotational operation, the cleaning blade 101 makes contact with and separates from the transfer surface.

The cleaning device 1' presses the cleaning blade 101 in the direction of making the cleaning blade 101 contact with the transfer surface by a pressing unit (not shown), composed of a tension spring. Further, the cleaning device 1 moves the cleaning blade 101 in the direction of separating the cleaning blade 101 from the transfer surface against a pressing force (in a direction F shown in the drawing) by the pressing unit using a cam not shown and releases the regulation to the cleaning blade 101 according to the pressing force, thereby moving the cleaning blade 101 in the direction of making contact with the transfer surface, thus controlling the contact and separation operation.

Further, as described above, the image forming apparatus of this embodiment has a regulation unit composed of the first regulation member 102 and the second regulation member 103. The regulation unit regulates the movement of the cleaning blade 101 in the direction of making contact with the transfer surface (cleaned surface) up to a predetermined position where the pressing force by the cleaning blade 101 to the cleaned surface does not exceed a predetermined value.

Figure 2:
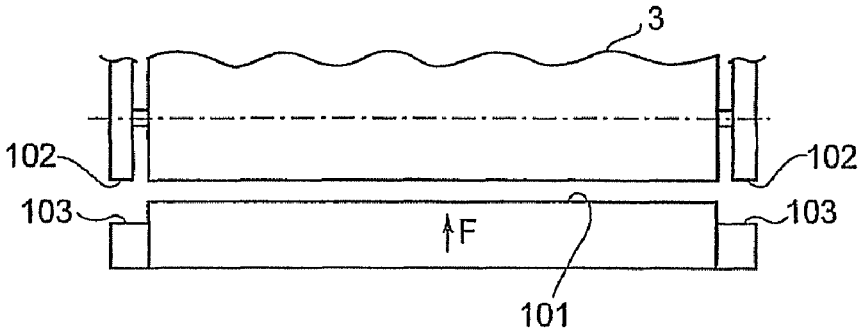
FIG. 2 is a plan view viewed in the direction of A shown in FIG. 1.

FIG. 2 is a drawing of the circumference of the cleaning device 1 of the image forming apparatus of this embodiment viewed in the direction A shown in FIG. 1. As shown in FIGS. 1 and 2, the first regulation member 103 is installed integrally with the cleaning blade 101 and moves integrally with the cleaning blade 101 when the cleaning blade 101 rotates with the rotating shaft R as a rotational center.

Further, the second regulation member 102 is installed integrally with an intermediate transferring belt unit (cleaned unit) having a transfer surface which is a cleaned surface and when the cleaning blade 101 is at the predetermined position aforementioned, makes contact with the first regulation member 103.

By use of such a constitution, in the cleaning blade 101, the speed when moving in the direction of making contact with the cleaned surface may be excessively high or the force for moving in the direction of contact may be excessively strong. In such a case, when the cleaning blade 101 collides straight with the transfer surface, excessive cutting may be caused. Also in such a condition, the first regulation member 102 and the second regulation member 103 make contact with each other, thereby functioning as a stopper for forcibly stopping the cleaning blade 101. Therefore, an excessive movement of the cleaning blade 101 causing excessive cutting is suppressed and an occurrence of excessive cutting can be prevented. By doing this, the life spans of the cleaning blade 101 and cleaned surface can be lengthened.

Further, in the cleanable state (when the cleaned surface is being cleaned), the first regulation member 102 and second regulation member 103 do not make contact with each other. By the balance between the force of repulsion of the cleaning blade 101 itself and the force of the tension spring for pressing the cleaning blade 101 to the cleaned surface, the first regulation member 102 and the second regulation member 103 are in the non-contact state. However, as mentioned above, when the speed for moving in the direction of making contact with the cleaned surface is excessively high or when the force for moving in the direction of making contact is excessively strong, the first regulation member 102 and the second regulation member 103 collide with each other.

Further, in this embodiment, the position (the position where the first regulation member 102 and the second regulation member 103 make contact with each other) where a regulation means composed of the first regulation member 102 and the second regulation member 103 is installed, in the direction of radius of rotation with the rotating shaft R of the cleaning blade 101 as a rotational center, is arranged outside the contact position (cleaning position) of the cleaning blade 101 with the cleaned surface.

By use of such a constitution, an excessive movement of the cleaning blade 101 in the contact direction can be regulated. Further, when the regulation means is positioned outside the radius of rotation beyond the cleaning position, the front end position of the cleaning blade 101 at the cleaning position can be specified more highly precisely.

Further, at least either of the first regulation member 102 and the second regulation member 103 is desirably composed of an elastic body such as rubber or a spring or felt. By doing this, a shock when the first regulation member 102 and the second regulation member 103 make contact with each other can be moderated and a shock sound can be reduced.

Further, when the cleaning blade 101 moves in the contact direction up to an appropriate position, even when the front end of the cleaning blade 101 makes contact with the cleaned surface, force against force by the pressing unit (not shown) in the direction F is generated naturally. Therefore, the movement of the cleaning blade 101 is regulated by a larger force than the force against the force in the direction F generated when the front end of the cleaning blade 101 makes contact with the cleaned surface. Therefore, at least either of the first regulation member 102 and the second regulation member 103 is desirably composed of an elastic body having higher hardness than that of the material of the cleaning blade 101.

Figure 3:
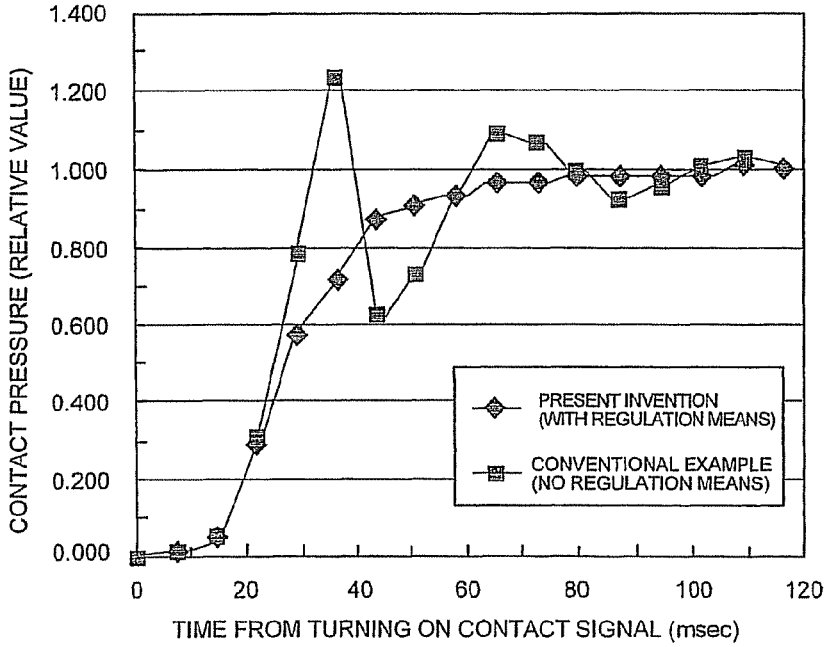
FIG. 3 is graphs of comparison of the situation of variations in contact force of a cleaning blade with a transfer surface of a intermediate transferring belt for each constitution of the cleaning device.
Figure 4:
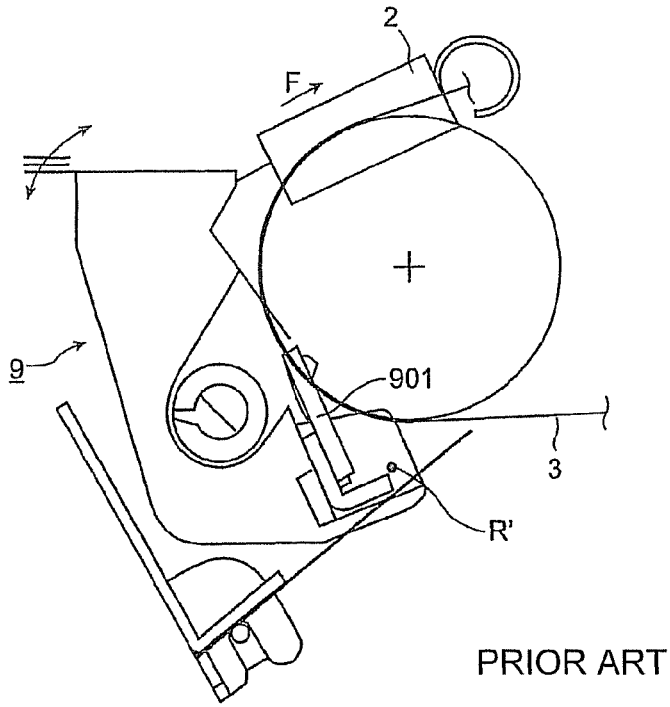
FIG. 4 is a schematic block diagram showing the peripheral constitution of a cleaning device of a conventional image forming apparatus.

When the cleaning blade 101 is separated from the intermediate transferring belt 3, a separation force to the cleaning blade 101 is released. Then, by the spring force, the cleaning blade 101 makes contact with the intermediate transferring belt 3. FIG. 3 shows graphs indicating changes in a contact force (expressed as a relative value assuming the value in a stationary state as 1) when the cleaning blade 101 makes contact with the transfer surface of the intermediate transferring belt 3 with time from a contact ON signal and shows a comparison of the case of the present invention having the regulation members 102 and 103 with the conventional case having no regulation members.

FIG. 3 shows that the contact force of the image forming apparatus in the conventional embodiment having no regulation members is varied greatly due to an occurrence of overshoot by excessive cutting. On the other hand, it is found that the constitution of the image forming apparatus of this embodiment hardly causes excessive cutting, thus the contact force is hardly varied.

The present invention is explained in detail by the specific embodiment, though it is obvious for those who are skilled in the art in the field of the present invention that various modifications and improvements are available without deviation from the spirit and scope of the present invention.

As described above in detail, according to the present invention, an image forming apparatus of an embodiment having a cleaning device composed of a cleaning blade making contact with and separating from a cleaned surface for preventing an occurrence of excessive cutting at time of making contact with the cleaned surface by the cleaning blade can be provided.

What is claimed is:

1. An image forming apparatus, comprising:

a cleaning blade which makes contact with and separates from a cleaned surface, and which scrapes off toner adhered onto the cleaned surface at time of contact; and a regulation member which has a higher hardness than a hardness of the cleaning blade and regulates a movement of the cleaning blade in a direction of contact with the cleaned surface.

2. The image forming apparatus according to claim 1, wherein the cleaning blade makes contact with and separates from the cleaned surface by rotating about a rotational center, and the regulation member is arranged outside a position where the cleaning blade makes contact with the cleaned surface.

3. The image forming apparatus according to claim 1, wherein the regulation member includes:

a first regulation member provided with the cleaning blade; and a second regulation member provided with a cleaned portion having the cleaned surface to make contact with the first regulation member when the cleaning blade makes contact with the cleaned surface.

4. The image forming apparatus according to claim 3, wherein the first regulation member has a higher hardness than that of the cleaning blade.

5. The image forming apparatus according to claim 3, wherein the second regulation member has a higher hardness than that of the cleaning blade.

6. The image forming apparatus according to claim 3, wherein the first regulation member and the second regulation member make contact with each other when a pressing force to the cleaned surface by the cleaning blade becomes a predetermined pressing force.

7. The image forming apparatus according to claim 6, wherein the first regulation member and the second regulation member do not make contact with each other when the cleaned surface is being cleaned.

8. The image forming apparatus according to claim 1, wherein the cleaned surface is an intermediate transferring belt.

9. An image forming apparatus, comprising:

a cleaning blade which makes contact with and separates from a cleaned surface, and which scrapes off toner adhered onto the cleaned surface at time of contact; and a regulation member arranged outside a position where the cleaning blade makes contact with the cleaned surface and regulates a movement of the cleaning blade in a direction of contact with the cleaned surface.

10. The image forming apparatus according to claim 9, wherein the cleaning blade makes contact with and separates from the cleaned surface by rotating about a rotational center, and the regulation member is arranged outside a position where the cleaning blade makes contact with the cleaned surface.

11. The image forming apparatus according to claim 9, wherein the regulation member includes:

a first regulation member provided with the cleaning blade; and a second regulation member provided with a cleaned portion having the cleaned surface to make contact with the first regulation member when the cleaning blade makes contact with the cleaned surface.

12. The image forming apparatus according to claim 11, wherein the first regulation member has a higher hardness than that of the cleaning blade.

13. The image forming apparatus according to claim 11, wherein the second regulation member has a higher hardness than that of the cleaning blade.

14. The image forming apparatus according to claim 11, wherein the first regulation member and the second regulation member make contact with each other when a pressing force to the cleaned surface by the cleaning blade becomes a predetermined pressing force.

15. A cleaning unit for an image forming apparatus, comprising:

a cleaning blade which makes contact with and separates from a cleaned surface, and which scrapes off toner adhered onto the cleaned surface at time of contact; and a regulation member which has a higher hardness than a hardness of the cleaning blade and regulates a movement of the cleaning blade in a direction of contact with the cleaned surface.

16. The cleaning unit according to claim 15, wherein the cleaning blade makes contact with and separates from the cleaned surface by rotating about a rotational center, and the regulation member is arranged outside a position where the cleaning blade makes contact with the cleaned surface.

17. The cleaning unit according to claim 15, wherein the regulation member includes:

a first regulation member provided with the cleaning blade; and a second regulation member provided with a cleaned portion having the cleaned surface to make contact with the first regulation member when the cleaning blade makes contact with the cleaned surface.

18. The cleaning unit according to claim 17, wherein the first regulation member has a higher hardness than that of the cleaning blade.

19. The cleaning unit according to claim 17, wherein the second regulation member has a higher hardness than that of the cleaning blade.

20. The cleaning unit according to claim 17, wherein the first regulation member and the second regulation member make contact with each other when a pressing force to the cleaned surface by the cleaning blade becomes a predetermined pressing force.

* * * * *